United States Patent [19]

Lindell

[11] 4,062,513

[45] Dec. 13, 1977

[54] VERTICALLY ADJUSTABLE WALL FORMS

[76] Inventor: Lawrence Edwin Lindell, 16866 Main St., La Puente, Calif. 91744

[21] Appl. No.: 612,473

[22] Filed: Sept. 11, 1975

[51] Int. Cl.[2] ..... E04G 11/06

[52] U.S. Cl. ..... 249/20; 249/33; 249/210; 425/65

[58] Field of Search ..... 249/19–22, 249/34, 207, 210, 33; 264/33–34; 425/65; 182/87

[56] References Cited

U.S. PATENT DOCUMENTS

| | | | |
|---|---|---|---|
| 2,719,347 | 10/1955 | Brekke | 249/22 |
| 3,044,573 | 7/1962 | Jackson | 182/87 |
| 3,222,750 | 12/1965 | Kimball | 425/65 |
| 3,472,477 | 10/1969 | Juhl | 249/20 |
| 3,628,223 | 12/1971 | Babee | 425/65 |
| 3,779,678 | 12/1973 | Scheller | 425/65 |

*Primary Examiner*—Robert L. Spicer, Jr.
*Assistant Examiner*—John McQuade
*Attorney, Agent, or Firm*—Gary Appel

[57] ABSTRACT

Apparatus for vertically adjusting forms used for constructing concrete walls poured in several horizontal segments comprises a jack and means for supporting the jack from a pair of adjacent she-bolts previously installed near the top of a previously poured wall segment. The supporting means includes a pair of hangers adapted for hanging from the she-bolts and a support member connected between lower portions of the hangers. For horizontal adjustment the jack is preferably mounted on a plate which is slidable along the support member and which may be clampable thereto. Lower portions of the concrete forms are modified by installation of headers and bearing plates to receive the jacking forces. In the preferred embodiment the jack supporting member is about as long as the spacing between adjacent she-bolts, or about two feet long. In a first variation the support member is constructed to be shorter, the hangers being inclined rather than vertical, and the jack being fixed to the support member. In other variations the jack is supported from a single she-bolt. In the first two of these variations the extendable portion of the jack is fitted with a stalled extension through which the she-bolt passes. Tubular elements receive and guide the extensions. In a first of these variations, the tubular element is fixed to a hanger by which the apparatus is hung. In a second of these variations, the apparatus is hung by apertures in the tubular element. In the third of these variations a long support member is centrally fixed to a formed hanger and a jack is mounted on the support member on each side of the hanger.

20 Claims, 17 Drawing Figures

VERTICALLY ADJUSTABLE WALL FORMS

BACKGROUND OF THE INVENTION

1. Field of the Invention

The present invention relates generally to the field of construction of high concrete wall structures and, more particularly, to apparatus for vertically adjusting and aligning concrete retaining forms used in such wall construction.

2. Description of the Prior Art

High poured concrete wall structures are usually constructed in steps by pouring one horizontal wall segment atop a previously poured segment, since it is often impractical to pour the entire height of the wall structure at one time. Such incremental construction requires that the concrete retaining forms be raised from one elevation to a next and be securely fixed to the top of one horizontal wall segment before the next higher segment is poured. These concrete retaining forms may be quite large—as high as 16 feet and as long as 30 feet—and, even though constructed largely of plywood, are very heavy. Special techniques are, thereof, required for installing the forms, leveling them, and retaining them firmly in position for receiving the liquid concrete.

Usually, as each horizontal wall segment is poured, a horizontal row of outwardly projecting bolts—called she-bolts— is installed, with the bolts on about two foot centers, at both the inside and outside of the wall, near the top of the segment. When forms are to be installed at the top of the poured segment, a crane lifts the forms, one at a time, into vertical position so that the lower form edge is slightly above the she-bolts. Leveling of the forms is accomplished by the crane operator making small positional movements of the forms and by other operators driving wedges between upper surfaces of the she-bolts and adjacent lower edges of the forms. When the forms are level, large integrated washer-nuts, referred to as catheads, are installed on the bolts. The catheads are then tightened, forcing lower edges of the form tightly against the existing wall segment, thereby retaining the forms in position. Installation is completed by conventionally tying opposing upper portions of inner and outer forms together. Later, when no longer needed, the she-bolts are unscrewed from the wall section and salvaged for re-use.

Leveling of the forms in the above described manner is difficult and hence time consuming and expensive. The great weight of the forms and the slight elasticity of their supporting cables makes small positional movements of the forms by a crane very slow and difficult, and ties up the crane for long periods of time, generally when it could be used to greater advantage elsewhere. This difficulty of the operation is generally increased after one lower corner of the form has been secured, since it is then necessary to side load the supporting cables to raise or lower the opposite corner.

And because it is difficult for a crane operator to precisely control movement of the forms, the operators installing the leveling wedges are in constant danger that their hands will be seriously injured by over movement of the forms.

For these and other reasons, there is a substantial need for an improved, faster and safer means for leveling such concrete wall forms.

SUMMARY OF THE INVENTION

In combination with a poured concrete wall structure having a plurality of horizontally, uniformly spaced concrete form supporting and retaining elements projecting outwardly from upper portions thereof and with concrete retaining forms for containing concrete as additional upper portions of the wall are poured, apparatus for adjusting the vertical positioning of the forms as they are installed and prior to their retention in place comprises jacking means for supporting and adjusting the vertical position of the forms and means for supporting the jacking means from at least one of the supporting and retaining elements. Means are fixed to those portions of the forms which cooperate with the jacking means for transmitting the jacking loads to the forms.

More particularly the jacking means includes a hydraulic jack and the supporting means includes a pair of hangers adapted to hang from a pair of the supporting and retaining elements and a jack supporting member fixed between lower portions thereof. The jack is preferably fixed to a plate which is slidable along and clampable to the support member for horizontal adjustment of the jack. The support member is about as long as spacing between adjacent supporting and retaining elements and the hangers are vertically disposed when the apparatus is installed.

Wooden headers are installed on portions of the forms to receive the jacking forces and bearing plates against which portions of the jacks bear are fixed to undersides of the headers.

In a first variation a short jack supporting member is employed, the jack being fixed thereto, and the hangers being inwardly inclined towards each other. A second variation apparatus employs a single hanger strap adapted for supporting the jack from one, rather than two, supporting and retaining element. The jack is fixed to an angle mounted on lower portions of the strap. A slotted extension connected to the extendable portion of the jack provides clearance for the supporting and retaining element from which the apparatus is hung and transmits the jacking force to a form positioned thereabove. The extension is guided and retained by a tubular element fixed to upper portions of the hanger.

In a third variation, similar to the second, the apparatus is suspended through apertures formed in the tubular element, the jack support being connected to members depending from lower portions of such element.

A fourth variation also employs a single hanger. An elongate jack support member, centrally fixed to lower portions of the hanger, mounts a jack on both sides of the hanger attachment location. The hanger is formed to enable an upper portion thereof to lay against a wall against which it is hung while the lower portion thereof is spaced away from the wall at a line between the two jacks.

In the manner described apparatus are formed for easily, economically and safely leveling forms associated with high wall structures, the amount of crane time required for leveling the forms thereby being substantially reduced.

BRIEF DESCRIPTION OF THE DRAWINGS

A better understanding of the present invention may be had from a consideration of the following description, taken in conjunction with the accompanying drawings in which.

DESCRIPTION OF THE PREFERRED EMBODIMENT

Figure 1:
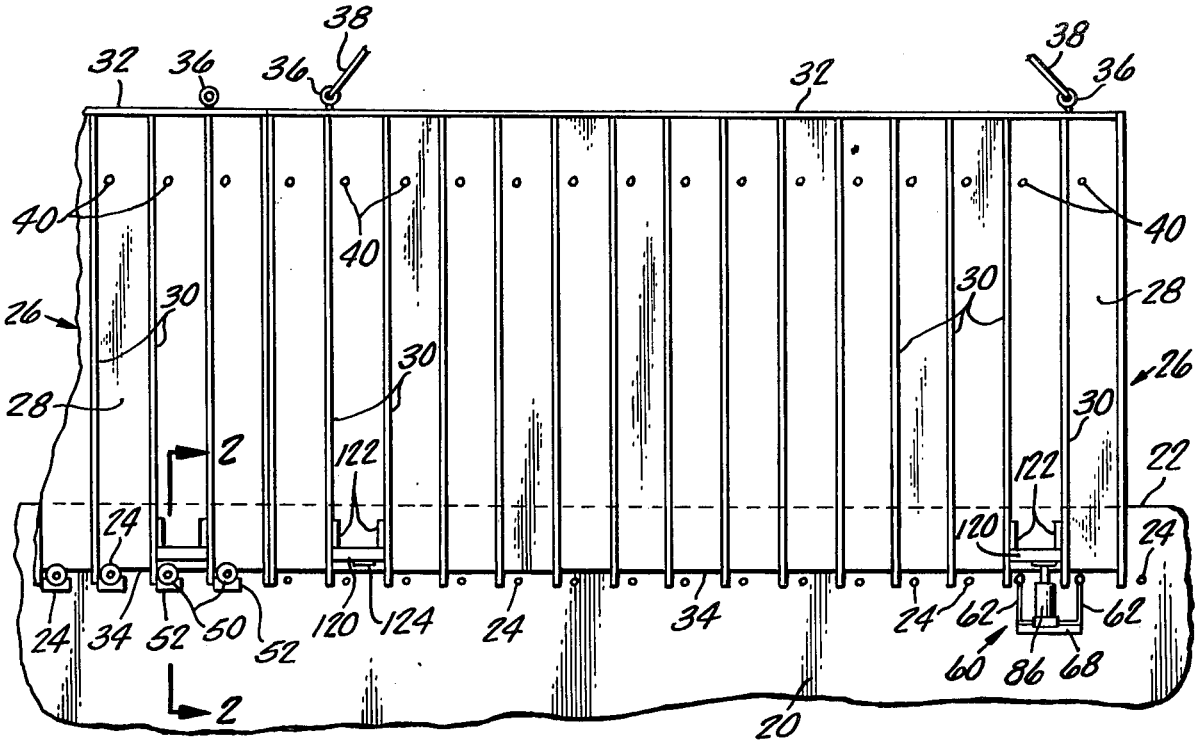
FIG. 1 is a vertical view, showing installation of concrete retaining forms as a wall structure.
Figure 2:
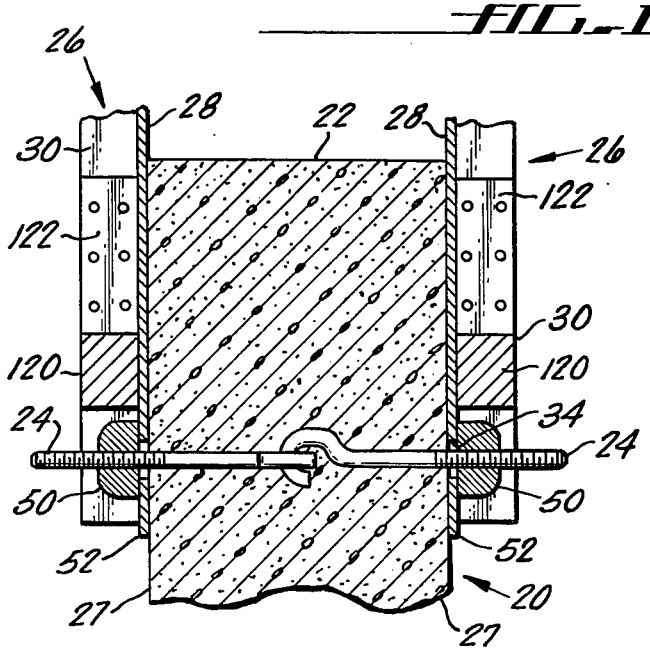
FIG. 2 is a vertical sectional view along line 2—2 of FIG. 1 showing means for retaining the concrete forms on the wall structure.

By way of introduction, and for better understanding of the present invention, FIG. 1 illustrates a concrete wall 20 in the process of being constructed. Spaced downwardly about a foot from an upper wall surface 22 is a row of horizontally spaced, outwardly projecting bolts 24 — called she-bolts — positioned to support and retain wall forms 26. The she-bolts 24, of conventional design, may be about three-fourths inch in diameter and are of a length so as to project outwardly a number of inches from wall surfaces 27 (FIG. 2). They are usually installed on 2 foot centers. Inner ends of the she-bolts 24 are formed into a semicircle so that opposing bolts from both sides of the wall may be hooked together to provide a strong installation.

Also illustrated in FIGS. 1 and 2 are typical concrete wall forms 26, which may be about 16 feet high and 30 feet long, comprising a flat plywood concrete retaining member 28 vertically reinforced at 2 foot intervals by 2 by 4 inch studs 30. An additional 2 × 4 reinforcing element 32 is attached to the member 28 and studs 30 along the top of the form. The studs 30 project about 4 inches below a bottom edge 34 of the member 28.

A pair of hooks or eyes 38 are attached to upper portions of the form 26 by means of which a crane (not shown) may lift the forms by a cable 38 passed through the eyes. A horizontal row of apertures 40, through which the she-bolts 24 are extended during construction of the wall, are formed downwardly from the top of the form 26.

Upon installation of the form 26 on upper portions of a wall 20 the form 26 is leveled, as more particularly described below, with the bottom edge 34 thereof just above the row of she-bolts 24. Wedges, not shown, may be used to help support the form 26 while combined washer-nuts 50 — called catheads — are threaded onto the she-bolts. A spacer strip 52, the thickness of the form member 28, is installed under lower portions of the washer portion of the cathead 50 for bearing purposes and the cathead 50 on each she-bolt 24 is tightened to force the lower portion of the form tightly against the wall surface 27 for supporting and retaining purposes. FIG. 2 illustrates a form 26 installed on both sides of the wall 20; elsewhere in the figures only the form 26 on one side of the wall 20 is shown, it being understood that a similar form 26 is also installed on the opposite side of the wall.

Neither the wall 20, the forms 26, (except the modifications described below), the she-bolts 24, or the catheads 50 form any part of the present invention, but are shown for the purpose of better describing the invention, a preferred embodiment and variations thereof being set forth below.

Figure 4:
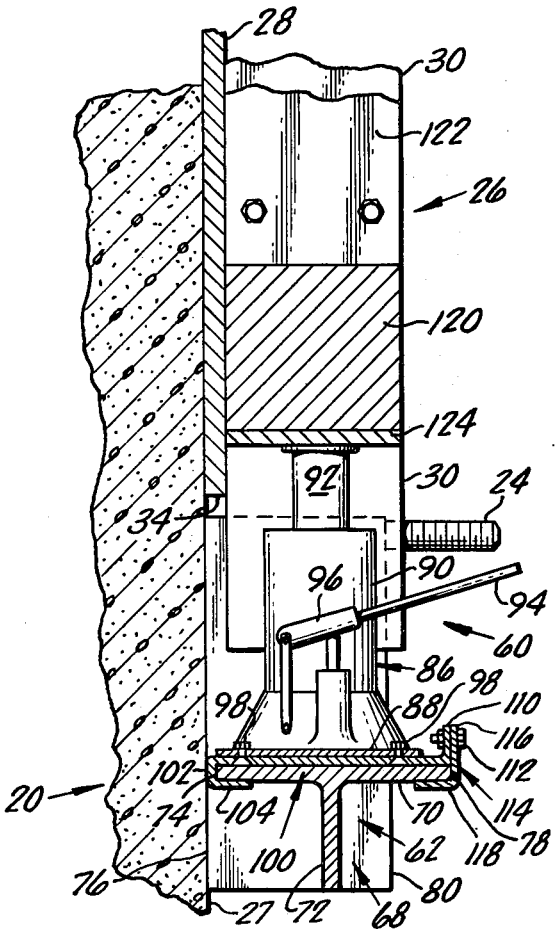
FIG. 4 is a vertical sectional view along line 4—4 of FIG. 3, showing features of the jacking apparatus and form modifications.
Figure 3:
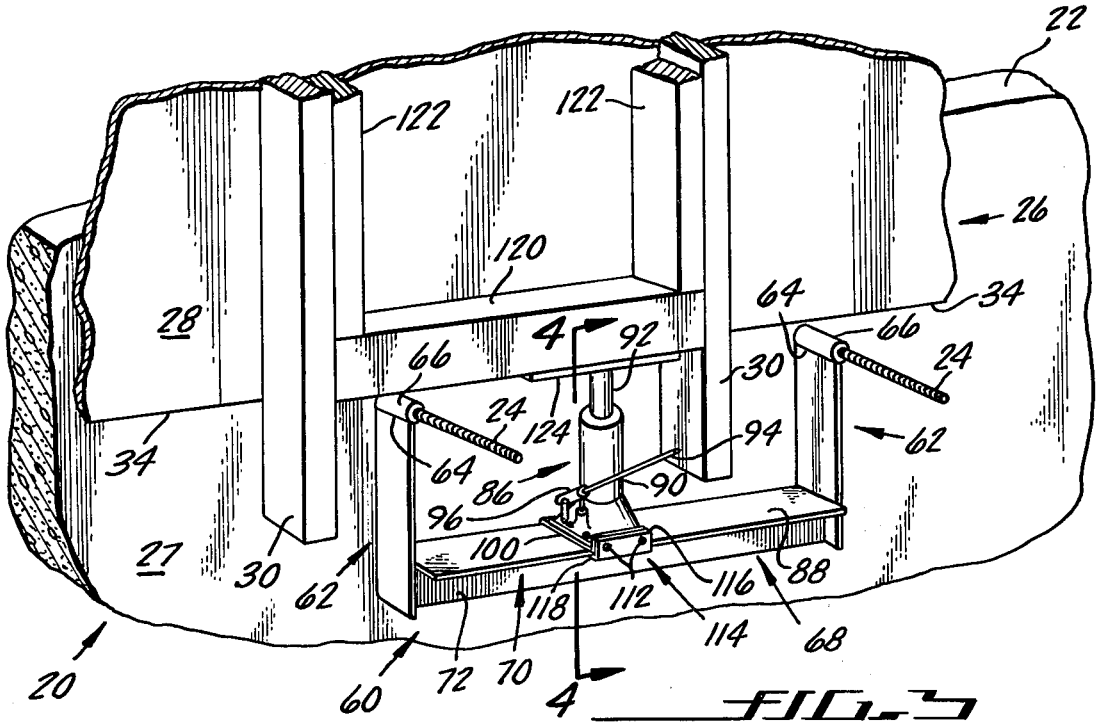
FIG. 3 is a perspective view, showing a jacking apparatus in position for leveling a concrete form.

Still referring to FIG. 1, as well as to FIGS. 3 and 4, an apparatus 60 for vertically adjusting and leveling the forms 26, as they are being installed and prior to the catheads 50 on the she-bolts 24 being tightened, includes a pair of spaced, vertically disposed hanger elements 62. Such elements 62 may be about 2 inches wide and 10½ inches long and be constructed of 3/16 steel bar material. To upper ends 64 of the hanger elements 62 are connected, by welding, steel she-bolt receiving tubes 66, which may be constructed from 1¼ inch schedule 80 pipe. Welded between lower portions of the hanger elements 62 is a jacking means support member 68 which comprises a tee having a 3 inch wide top portion 70 and a 2½ inch vertical leg 72, and which is formed of 5/16 inch thick steel. A rear edge 74 of the top portion 70 is positioned slightly outwardly (to be away from the wall surface 27 upon installation, for reasons to become apparent, from a rear edge 76 of the hanger element 62 (FIG. 4). A front or outer edge 78 of the top portion 70 extends a little more than an inch beyond a front or outer edge 80 of the hanger element 62.

A jacking element 86, mounted upon an upper surface 88 of the support member top portion 70, comprises, for example, a conventional hydraulic jack having a base portion 90 and a vertically extendable portion or piston 92, and which may have about a 1½ ton capacity. Operation of the jacking element 86 is by means of a handle 94 which is installed in a socket portion 96 of the element. Other types of non-hydraulic jacks may also be used; however, a hydraulic jack has the advantage of enabling easy raising and lowering of the extendable portion and being relatively compact for its capacity.

Although the base portion 90 of the jacking element 86 may be bolted or otherwise fixedly mounted to the support member 68, it is preferably slidably mounted on the top portion 70, as shown in FIGS. 3 and 4. To this end, the base portion 90 is mounted by bolts 98 to a base plate 100 which extends across the width of the top portion 70 and which has a rear portion 102 formed downwardly and then forwardly under the rear edge 74 of the top portion. A flange 104, thus formed under the top portion 70, retains the rear portion 102 of the plate upon the top portion of the support member 68. A forward portion of the plate 100, adjacent to the front edge 78 of the top portion 70, is bent upwardly to form a vertical flange 110, the outer face of which is positioned slightly inwardly from the top portion front edge, for reasons to become apparent. The plate 100 is constructed, for example, from 13 gauge sheet steel.

Connected to the flange 110, by bolts 112, is a steel angle 114 having a vertical leg 116 and a horizontal leg 118 which extends rearwardly under front portions of the top portion 70 to retain the plate 100 on such top portion.

With the bolts 112 loose, the plate 100 and the attached jacking element 86, and the angle 114 may be slid horizontally along the support member top portion 70 to align the jacking element with jacking portions of the form 26. When the jacking element is properly aligned, the bolts 112 are tightened to clamp or lock the plate 100 and angle 114 to the top portion 70, thereby preventing movement of the plate, angle and jacking element along the top portion.

Since the forms 26 are constructed mainly of plywood for strength and lightness, there is little structure in lower portions to which jacking forces may be applied by the apparatus 60. The forms 26 must, therefore, be modified to add supporting and bearing portions. A 4 × 4 wood beam or header 120 is fixed between lower end portions of adjacent form studs 30 near both ends of the forms 26 (FIGS. 1–4). The header 120 is supported or tied into the rest of the form by 2 × 4 members 122 fixed to insides of the studs 30 above end portions of the headers. These members 122 may be only a few feet long (as shown) or may extend the entire height of the form 26. To protect the header 120 during the jacking operation, a steel bearing plate 124 is fixed to underside portions of the header.

Operation

Operation of the apparatus 60 is generally apparent from the foregoing description and associated Figures. The form 26 is lowered by a crane to a position just above the row of she-bolts 24. The apparatus 60 is hung from a pair of she-bolts 24, by sliding the tubes 66 over the bolts, in the region of the header 120. The jacking element 86 is slid along the support member 68 until it is aligned with the bearing plate 124, after which the bolts 112 are tightened to clamp the jacking element in position.

For a first form 26, an apparatus 60 is positioned at each or header 120. After the first form is leveled by the jacking apparatus 60 and secured in position by installation of catheads 50 on the supporting she-bolts 24, an end portion of a next form 26 is nailed, bolted or otherwise fastened to the adjacent end of the first form, in alignment therewith. As a result, it is usually necessary to employ only one apparatus 60 at the free end of the form, although an apparatus 60 may be employed at each of the headers 120, if desired or necessary.

It is emphasized that after the jacking elements 86 are in position and are extended to temporarily support the form 26, and before the leveling operation begins, the crane is no longer required to support the forms and may be used elsewhere, thus saving substantial expensive crane time. Leveling of the forms 26 is easily accomplished thereafter by operation of the jacking elements 86. The forms, during the leveling operation, may be held in general position by loose installation of catheads 50 on one or more she-bolts.

Wedges (not shown) may be installed between some of the she-bolts 24 and the lower edge 34 of the form 26, after the form is leveled, to help support the form and, if desired, one or more of the apparatus 60 may be left in supporting position.

Figure 5:
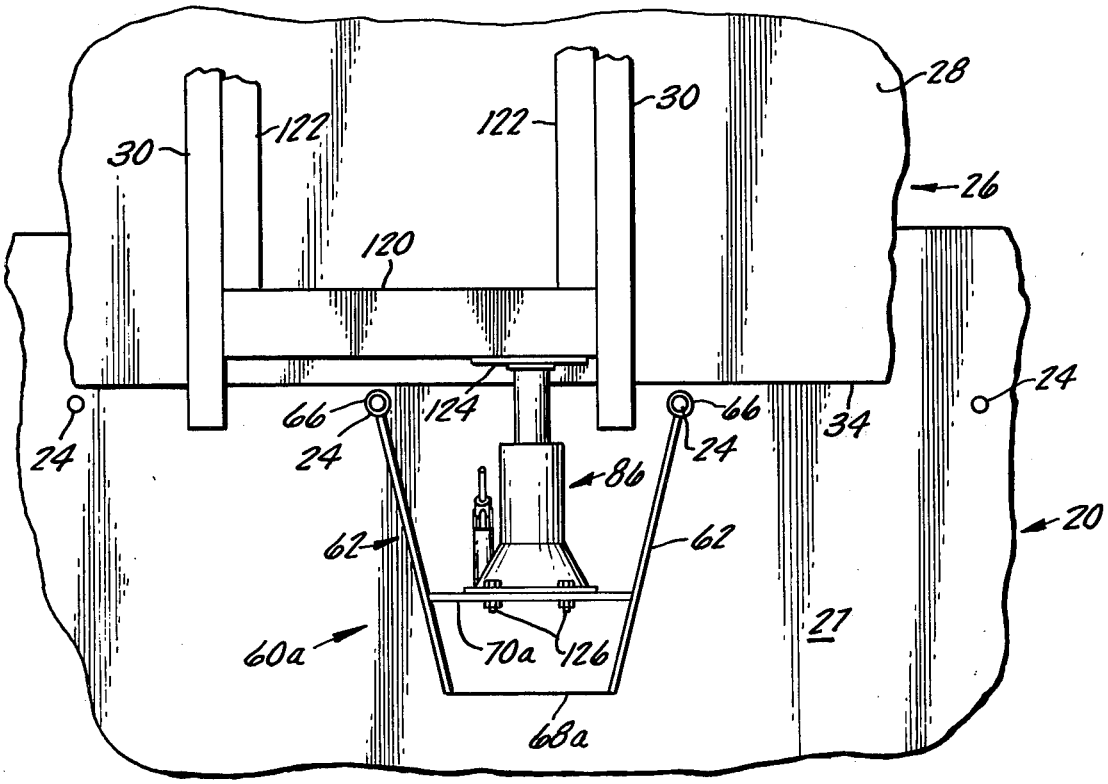
FIG. 5 is a vertical view of a first variation jacking apparatus having a short jacking element support member.

Variations of FIG. 5

Although the support member 68 was shown in FIGS. 1 and 3, and was above described, as having a length about equal to the spacing between adjacent she-bolts 24, that is, about 2 feet, it may be made longer to span more than 2 she-bolts alternatively, it may be made shorter, to be smaller and lighter, as shown in FIG. 5. In FIG. 5, a first variation jacking apparatus **60*a* is shown having a supporting member 68*a* substantially shorter than the spacing between adjacent she-bolts 24. To allow the hanger elements 62 to hang from adjacent she-bolts 24, ends of the member 68*a* are cut at an angle, the support elements connected thereto being inwardly inclined at that angle. The jacking element 86 may be bolted in place on the supporting member 68*a* (as shown in FIG. 5) or may be slidably, and easily removably mounted thereupon, as above described, by means of the plate 100 and angle 114. Except as just mentioned, the apparatus 60*a* is the same as the apparatus 60**, and its operation is the same.

Variation of FIGS. 6–11

FIGS. 6–11 illustrate a second variation jacking apparatus **60*b*, adapted for hanging from one she-bolt 24 rather than from two. In some circumstances, the apparatus 60*b* may thus be preferable over the apparatus 60 and 60*a***, as it will be lighter weight and somewhat easier to handle.

As best seen in FIGS. 7–10, a support hanger 134 is formed of a bar of metal bent double in the center to form an elongate, U-shaped structure, an upper, bent over portion 136 being adapted for hanging over a single she-bolt 24. Lower portions 138 of the hanger 134 are bent outwardly from each other to form a Vee (FIG. 10), to outer surfaces 140 of which is attached, as by welding, a vertical leg 142 of an angle 144. A lower horizontal leg 146 of the angle 144 projects outwardly from the hanger 134 to provide support for the jacking element 86, which is mounted thereto by bolts 148.

The hanger 134 may be about 10½ inches high and may be formed from a steel bar about 1–1½ inches wide and 3/16 – 5/16 inch thick. The angle 144 may be about 3 by 3 inches and about 5–6 inches long, and may be constructed of about 5/16- inch thick steel.

Figure 6:
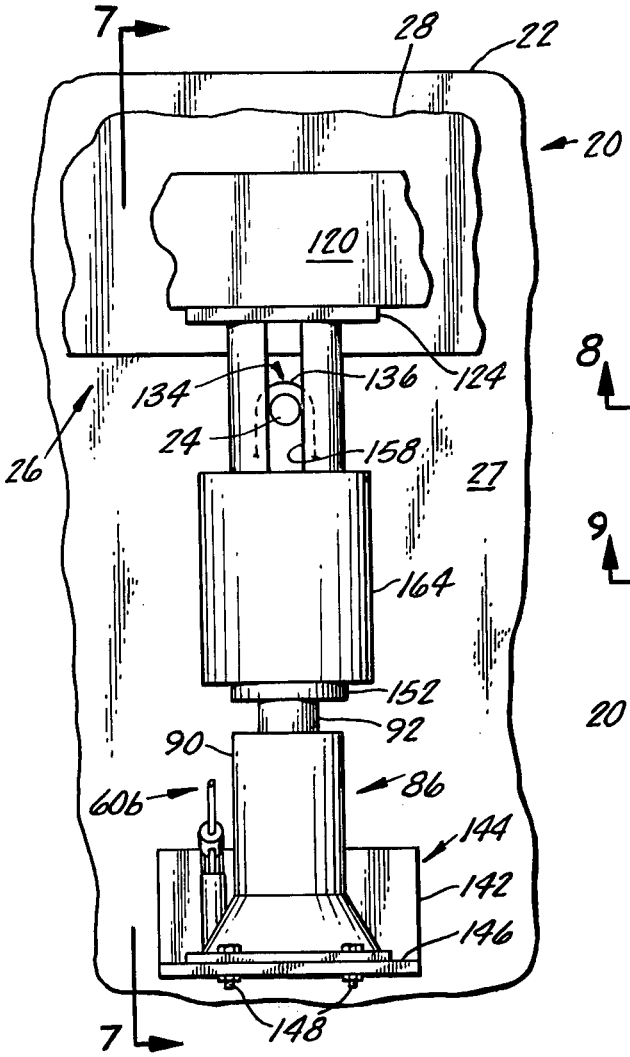
FIG. 6 is a vertical view of a second variation jacking apparatus adapted for hanging from a single she-bolt.
Figure 7:
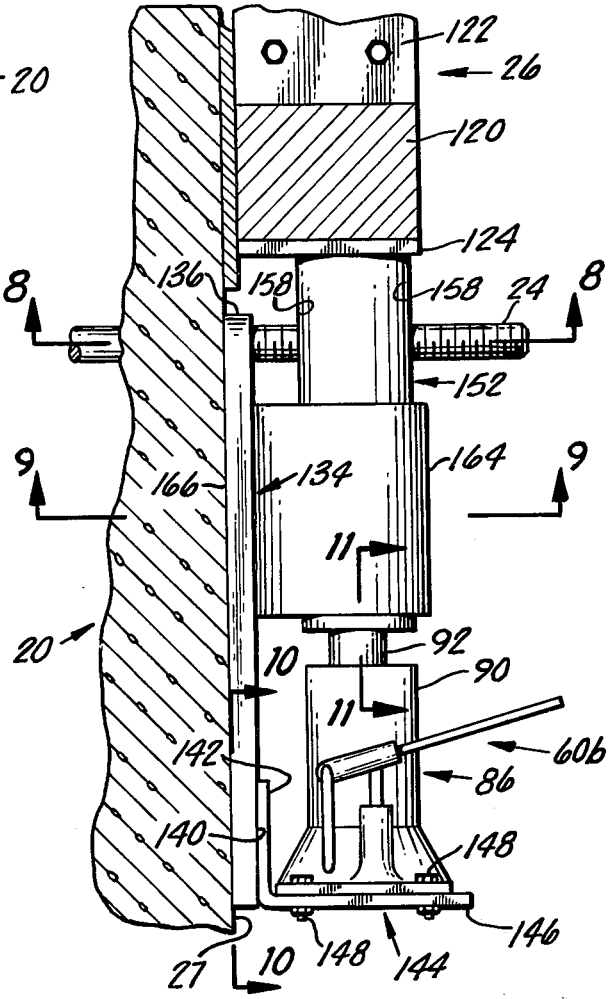
FIG. 7 is a vertical view along line 7—7 of FIG. 6, showing features of the second variation jacking apparatus.
Figure 8:
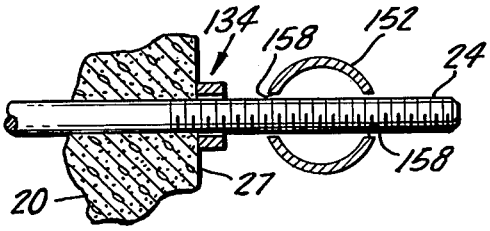
FIG. 8 is a horizontal sectional view along line 8—8 of FIG. 7, showing details of the hanger strap and jack extension some of the elements that would normally be seen from the view lines have not been shown for the sake of clarity.
Figure 10:
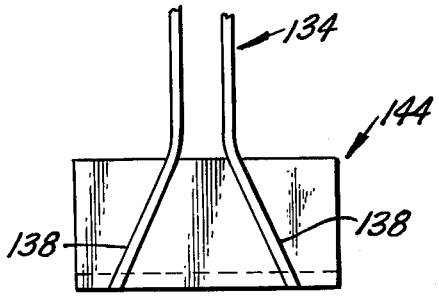
FIG. 10 is a vertical view along line 10—10 of FIG. 7, showing the hanger strap connected to a jacking element support member, some of the elements that would normally be seen from the view lines have not been shown for the sake of clarity.
Figure 9:
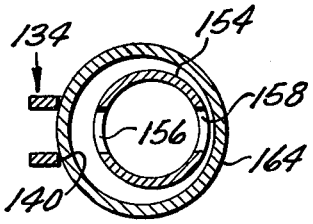
FIG. 9 is a horizontal sectional view along line 9—9 of FIG. 7, showing the hanger strap and jack extension guide, some of the elements that would normally be seen from the view lines have not been shown for the sake of clarity.
Figure 11:
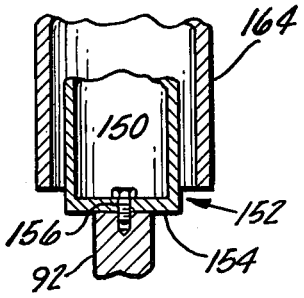
FIG. 11 is a vertical sectional view along line 11—11 of FIG. 7, showing attachment of the extension to the jacking element of the second variation.
Figure 12:
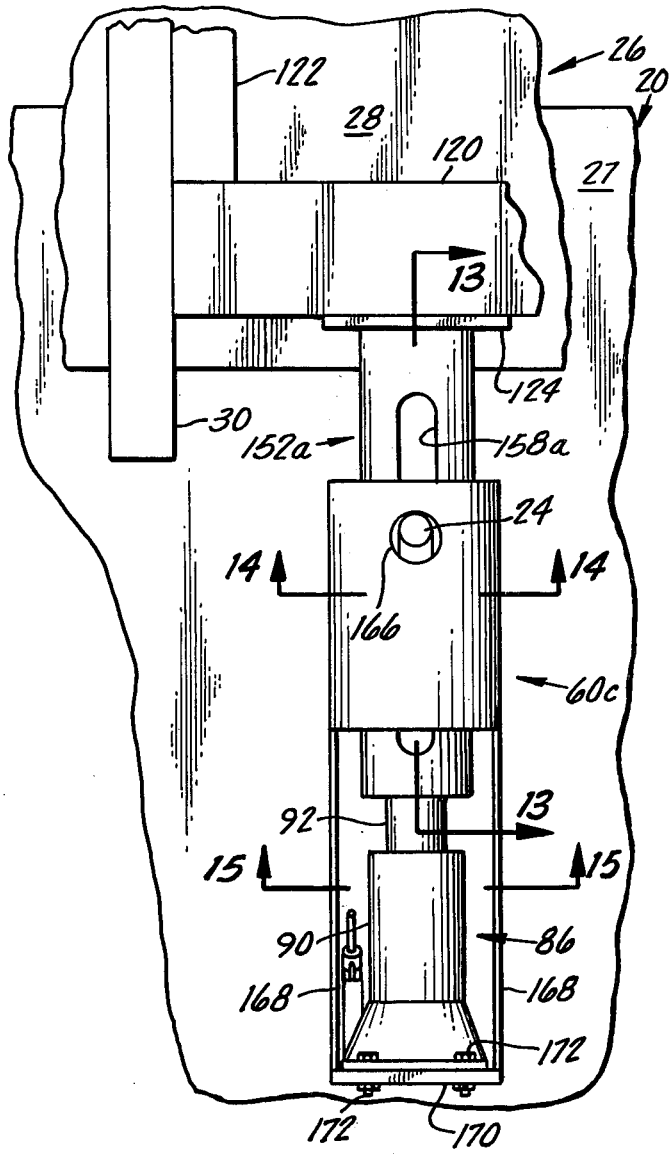
FIG. 12 is a vertical view of a third variation jacking apparatus also adapted for hanging from a single she-bolt.

Connected to the upper end of the extendable portion 92 of the jacking element 86, by a bolt 150, is an elongate tubular extension 152 having a closed bottom portion 154, through an aperture 156 of which the bolt passes (FIG. 11). The extension 152 is vertically displaced and transmits jacking forces from the jacking element 86, past the projecting she-bolt 24 and to the bearing plate 124 attached to the form header 120 (FIGS. 6 and 7). To this end, slots 158 are axially formed in central and upper portions of the extension 152 to provide clearance for the she-bolt 24 upon which the apparatus **60*b* is hung (FIG. 8). The slots 158 are sufficiently long to permit full travel of the extendable portion 92 of the jacking element 86 without interference with the she-bolt 24. As shown, the slots 158 completely extend to the upper end of the extension 152**; however, the slots may alternatively terminate below the upper end of the extension and thus be closed.

Preferably, the extension 152 is formed of about 1½ heavy walled pipe and is about 6 to 8 inches long, and the slots 158 are about seven-eighths inch wide. Alternatively, the extension 152 may be constructed from a solid cylinder, the lower end being welded to the upper end of the extendable portion 92.

Fixed to the outer hanger surface 140, in an upper, central region thereof, is a tubular steel guide element 164 having an inner diameter larger than the outer diameter of the extension 152 so that such extension fits loosly therewithin, the guide element functioning as both a retainer and guide for the extension. The element 164 is constructed of heavy wall steel pipe which may be about 2 inches in diameter.

In operation, the hanger 134 is hung from a single she-bolt 24 in the location of a bearing plate 124 on the form 26, with the she-bolt extending through the slots 156 in the extension 152, and with a rear surface 166 of the hanger flush against the wall surface 27. It will be noted that the upper end of the guide element 164 is positioned to be below the she-bolt and thus also functions somewhat as a retainer to retain the apparatus **60*b* on the bolt. The jacking element 86 is operated in a conventional manner to support and adjust the vertical position of the form 26**.

Variation of FIGS. 12–15

A third variation of jacking apparatus **60*c*, illustrated in FIGS. 12–15, is generally similar to the apparatus 60*b* described above, being also adapted for hanging from a single she-bolt 24. Instead of utilizing a hanger 134, the apparatus 60*d* is hung by passing a she-bolt 24 through apertures 166 formed in upper regions of a tubular steel guide element 164*a***.

Two elongate members 168 extend downwardly from the lower end of the guide element **164*a*, being formed as part thereof or welded thereto. A steel plate 170 is welded to lower ends of such members. The jacking element 86 is fixed to the upper surface of the plate 170 by bolts 172**.

Figure 13:
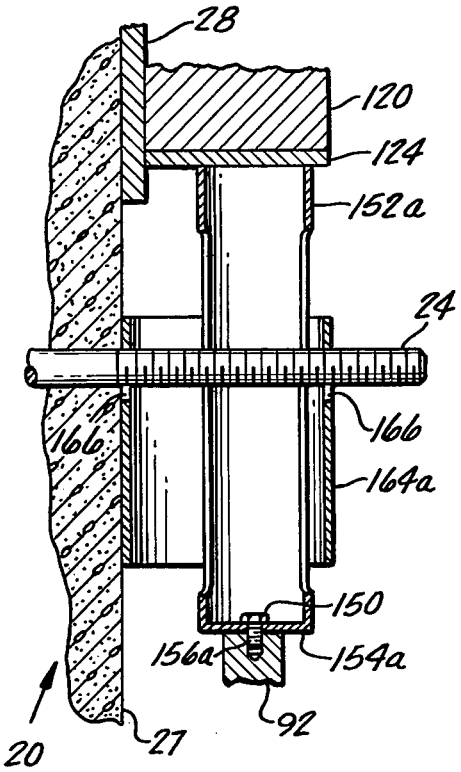
FIG. 13 is a vertical sectional view along line 13—13 of FIG. 12, showing features of the third variation jacking apparatus.
Figure 14:
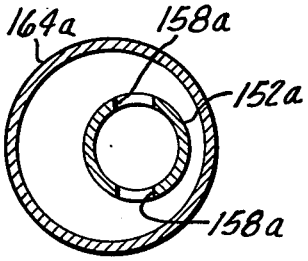
FIG. 14 is a horizontal sectional view along line 14—14 of FIG. 12, showing the jack extension and extension guide of the third variation.
Figure 15:
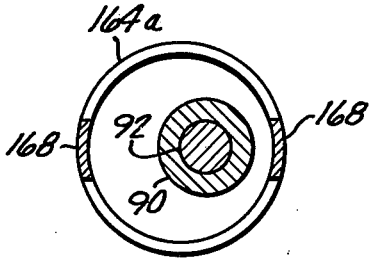
FIG. 15 is a horizontal sectional view along line 15—15 of FIG. 12 showing other features of the third variation jacking apparatus.

Fixed to the upper end of the jacking element portion 92, is a tubular extension **152*a*, which is similar to the above described element 152 except that, as shown, slots 158*a* are closed and terminate below the top end of the extension. For mounting the extension 152*a* to the portion 92, a bolt 150*a* is passed through an aperture 156*a* in the bottom end 154*a* of the extension (FIG. 13**).

Installation and operation of the apparatus **60*c* is substantially as described above for the apparatus 60*b*, except the she-bolt 24 is received through the cylinder apertures 166**.

Figure 16:
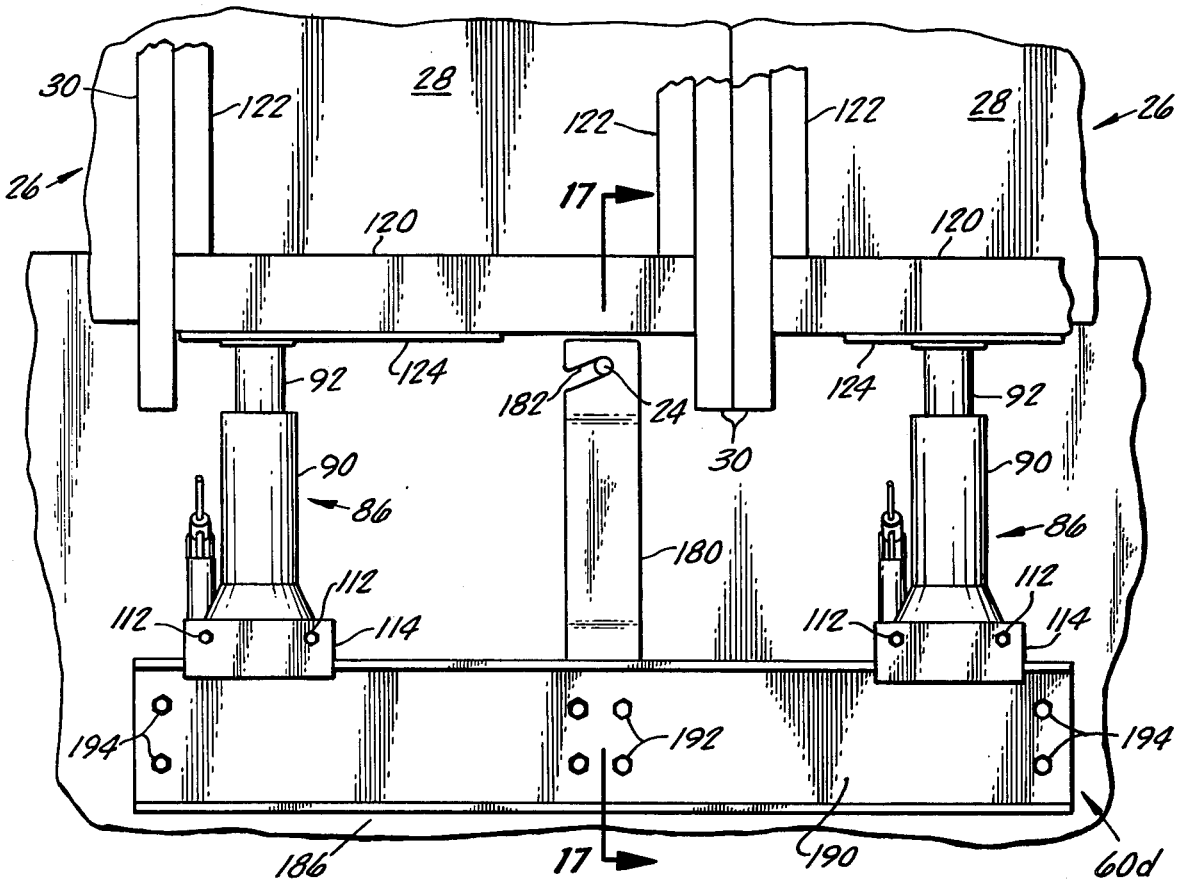
FIG. 16 is a vertical view of a fourth variation jacking apparatus adapted for hanging from a single she-bolt and employing two jacking elements.
Figure 17:
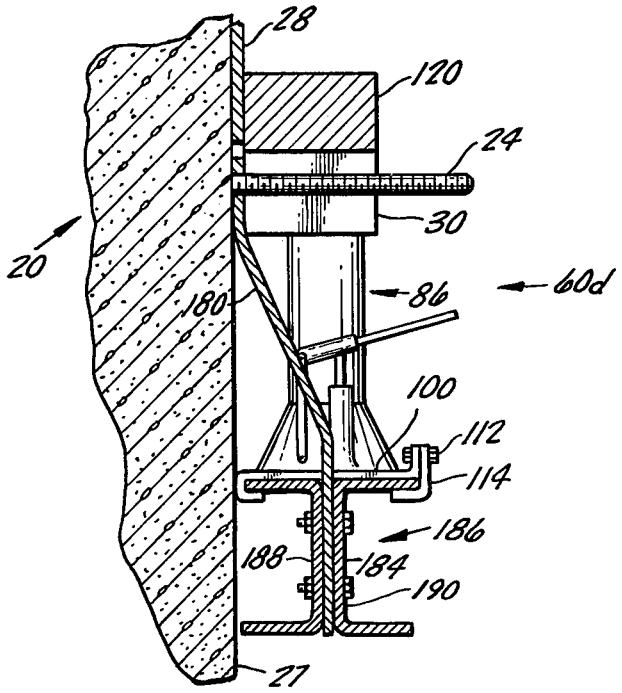
FIG. 17 is a vertical sectional view along line 17—17 of FIG. 16, showing details of the fourth variation hanger strap and jacking element support.

Variations of FIGS. 16 and 17

FIGS. 16 and 17 illustrate a fourth variation jacking apparatus **60*d* adapted for hanging from a single she-bolt 24, but which utilizes two jacking elements 68. The apparatus 60*d* is useful, for example, in leveling and supporting adjacent ends of two forms 26**.

A hanger 180 is provided which has at an upper region, an upwardly angled slot 182 for receiving a she-bolt 24. The hanger 180 may be about 2 inches wide and about 10½ inches long and may be constructed from 3/16 to 5/16 sheet steel. Below the slot 182, the hanger 180 is bent outwardly, at an angle of about 15° to 20°, and then downwardly in a lower region so that a lower portion 184 thereof, when the apparatus **60*d* is installed, is vertical and is spaced outwardly from the wall surface 27 (FIG. 17**).

Fixed to the lower hanger portion 184 is a horizontal jacking element support 186 which comprises inner and outer steel channels 188 and 190, respectively. The channels 188 and 190 are arranged in back-to-back relationship and have sandwiched therebetween, at their horizontal center, the lower hanger portion 184. Bolts 192, passing through the channels 188 and 190 and the portion 184 assemble the support 186 to the hanger 180. End portions of the channels 188 and 190 are spaced apart by suitable spacers (not shown) and are bolted together by bolts 194. The channels 188 and 190 may have a depth of about 30 inches, a length of about 2 feet, and may be about 5/16 inch thick; when assembled as described, their combination width may be about 3 inches.

On each upper end portion of the support 166, a jacking element 86 is mounted. Preferably, both jacking elements 86 are slidably mounted, as above described for the apparatus 60, by means of plates 100 and angles 114, being clampable in position by the bolts 112. Alternatively, the jacking elements may be fixed to the member 186 in a conventional manner.

For use with the apparatus **60*d*, forms 26 are modified by installing the headers 120 immediately adjacent to the ends (FIG. 16) instead of inwardly therefrom as was illustrated in FIG. 1. If the apparatus 60*d* is to be used with a single form, the header 120 is extended from one stud 30 across a second stud 30 to a third stud. Header support members 122** are installed as above described.

After the apparatus **60*d* is hung from a single she-bolt 24 operation thereof is substantially as described above, except that both jacking elements 86** are adjusted.

It is to be appreciated that although two of the jacking apparatus **60–60*d* are normally used with the first installed form 26 and only a single apparatus is used with subsequent forms, two or more than two apparatus may be used with the first and any subsequent form 26**.

In the manner described, form leveling apparatus are constructed which are comparatively inexpensive, which are simple, reliable and safe to use and which require minimal crane time.

Although there have been described above specific arrangements of an apparatus for vertically adjusting forms used for poured concrete walls, in accordance with the invention, for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

I claim:

1. In combination with a poured concrete wall structure having a plurality of horizontally, uniformly spaced concrete form supporting and retaining elements projecting outwardly from upper portions thereof and with concrete retaining forms for containing concrete as additional upper portions of said wall structure above the supporting and retaining elements are poured, apparatus for adjusting the vertical positioning of the forms as they are installed and before they are retained in position, said apparatus comprising:

a. jacking means cooperating with said forms for supporting said forms in a concrete receiving position adjacent to said wall structure and for adjusting the vertical position of said forms as the forms are being installed on said wall structure, and b means cooperating with said jacking means and supporting said jacking means from at least one of said supporting and retaining elements while the vertical position of the form is being adjusted by the jacking means and for permitting removal of the jacking means from engagement with the forms after the forms are installed on the wall structure said means cooperating with the jacking means being removable from the form supporting and retaining elements after the forms are installed.

2. The apparatus as claimed in claim 1, including means fixed to lower portions of said forms for receiving jacking forces from said jacking means and for transmitting said forces to said forms.

3. The apparatus as claimed in claim 2, wherein said means for receiving jacking forces includes a horizontally mounted header member and a bearing plate fixed to under portions thereof.

4. The apparatus as claimed in claim 1, wherein said jacking means includes a hydraulic jack and means for operation thereof.

5. The apparatus as claimed in claim 1, wherein said supporting means includes hanger means hanging from a single one of said supporting and retaining elements.

6. The apparatus as claimed in claim 5, wherein said jacking means includes a single jacking element supported vertically below a supporting and retaining element and having fixed to a vertical extendable portion thereof an elongate, vertically disposed extension member having formed therein at least one supporting and retaining element receiving slot, said slot having a length at least about equal to the length of vertical travel of said extendable portion whereby the jacking element is enabled to exert a vertical adjusting force on a portion of a form above the projecting supporting and retaining element.

7. The apparatus as claimed in claim 6, wherein said supporting means includes a vertically disposed cylinder through inner portions of which portions of said extension member are disposed, said cylinder retaining and guiding said extension member as it is vertically moved by said jacking element extendable portion.

8. The apparatus as claimed in claim 7, wherein said supporting means includes a hanger strap having an upper portion formed to hang over a supporting and retaining element and having fixed to lower portions thereof an outwardly projecting jacking means supporting member.

9. The apparatus as claimed in claim 8, wherein said cylinder is radially fixed to portions of said hanger strap intermediate said upper and lower portions, said cylinder being thereby disposed below the supporting and retaining element from which the apparatus is hung.

10. The apparatus as claimed in claim 7, wherein upper wall portions of said cylinder are apertured whereby said cylinder may be hung from a supporting and retaining element for supporting said jacking means therefrom.

11. The apparatus as claimed in claim 10, wherein a jacking means supporting member is suspended from lower portions of said cylinder.

12. The apparatus as claimed in claim 5, wherein said supporting means comprises an elongate hanger element adapted at an upper end portion for hanging over a supporting and retaining element and having fixed to lower portions thereof an elongate jacking means support positioned to be generally horizontal and parallel to the wall structure when the hanger element is hung from a supporting and retaining element, and wherein said jacking means comprises first and second independent jacking elements, said first jacking element being mounted on a first portion of said support to one side of said hanger element and said second jacking element being mounted on a second portion of said support to the opposite side of said hanger element.

13. The apparatus as claimed in claim 12, wherein said hanger element is formed to have upper portions thereof adjacent to and to have lower portions thereof spaced outwardly from the wall structure when said hanger element is hung from a supporting and retaining element, said lower portions being positioned about on a vertical plane joining centers of said first and second jacking elements.

14. The apparatus as claimed in claim 12, wherein said jacking elements are slidably mounted on said support.

15. In combination with a poured concrete wall structure having a plurality of horizontally, uniformly spaced concrete form supporting and retaining elements projecting outwardly from upper portions thereof and with concrete retaining forms for containing concrete as additional upper portions of said wall structure above the supporting and retaining elements are poured, apparatus for adjusting the vertical positioning of the forms as they are installed and before they are retained in position, said apparatus comprising:

a. jacking means cooperating with said forms for supporting said forms and adjusting the vertical position of said forms as the forms are being installed on said wall structure, and b. means cooperating with said jacking means and supporting said jacking means from at least one of said supporting and retaining elements, said supporting means including first and second hanger elements having upper portions thereof hanging from different ones of said supporting and retaining elements and a jacking means supporting member connected between lower portions of said hanger elements to be substantially horizontal when said hanger elements are hung from said supporting and retaining elements.

16. The apparatus as claimed in claim 15, wherein the length of said supporting member is such that said first and second hanger elements are generally vertically disposed when said apparatus is hung from said supporting and retaining elements.

17. The apparatus as claimed in claim 16, wherein said jacking means supporting member is about as long as the spacing between adjacent ones of said supporting and retaining elements.

18. The apparatus as claimed in claim 15, wherein said supporting means includes means for horizontally adjusting the position of said jacking means along said jacking means supporting member.

19. The apparatus as claimed in claim 18, wherein said horizontal adjusting means includes means for locking said jacking means in any selected horizontal adjustment position.

20. The apparatus as claimed in claim 15, wherein said jacking means support member is substantially shorter than the spacing between adjacent ones of said supporting and retaining elements, lower portions of said hanger elements being thereby caused to be inclined inwardly towards each other.

* * * * *